US005527658A

United States Patent [19]

Hopper et al.

[11] Patent Number: 5,527,658

[45] Date of Patent: Jun. 18, 1996

[54] TONER AGGREGATION PROCESSES USING WATER INSOLUBLE TRANSITION METAL CONTAINING POWDER

[75] Inventors: Michael A. Hopper, Toronto; Raj D. Patel, Oakville; H. Bruce Goodbrand, Hamilton; Grazyna E. Kmiecik-Lawrynowicz, Burlington, all of Canada

[73] Assignee: Xerox Corporation, Stamford, Conn.

[21] Appl. No.: 403,043

[22] Filed: Mar. 13, 1995

[51] Int. Cl.[6] ..... G03G 9/08

[52] U.S. Cl. ..... 430/137; 523/335

[58] Field of Search ..... 430/137, 106.6, 430/901; 523/335

[56] References Cited

U.S. PATENT DOCUMENTS

| | | | |
|---|---|---|---|
| 4,286,037 | 8/1981 | Hectors et al. | 430/137 |
| 4,609,607 | 9/1986 | Takagi et al. | 430/137 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |

OTHER PUBLICATIONS

Diamond, Arthur S., *Handbook of Imaging Materials.* New York: Marcel–Dekker, Inc., pp. 178, 190–193, & 195, (1991).

*Primary Examiner*—Christopher D. Rodee
*Attorney, Agent, or Firm*—E. O. Palazzo

[57] ABSTRACT

A process for the preparation of toner comprising:

(i) preparing a pigment dispersion comprised of pigment, an ionic surfactant, and optionally a charge control agent;

(ii) shearing said pigment dispersion with a latex comprised of resin, a counterionic surfactant with a charge polarity of opposite sign to that of said ionic surfactant, and a nonionic surfactant;

(iii) heating the above sheared blend of (ii) about below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder ionic surfactant in an amount of from between about 0.05 and about 5 weight percent based on the weight of the aggregates; and (iv) heating said bound aggregates about above the Tg of the resin to form toner.

4 Claims, No Drawings

TONER AGGREGATION PROCESSES USING WATER INSOLUBLE TRANSITION METAL CONTAINING POWDER

BACKGROUND OF THE INVENTION

The present invention is generally directed to toner processes, and more specifically, to aggregation and coalescence processes for the preparation of toner compositions. In embodiments, the present invention is directed to the economical chemical preparation of toners, especially toners with a spherical shape, without the utilization of the known pulverization and/or classification methods, and wherein in embodiments toner compositions with an average volume diameter of from about 1 to about 25, and preferably from 1 to about 10 microns and narrow GSD of, for example, from about 1.16 to about 1.26 as measured on the Coulter Counter can be obtained. The resulting toners can be selected for known electrophotographic imaging, printing processes, including color processes, and lithography and especially as single component toners and magnetography. In embodiments, the present invention is directed to a process comprised of dispersing a pigment and optionally toner additives like a charge control agent or additive in an aqueous mixture containing an ionic surfactant in an amount of from about 0.5 percent (weight percent throughout unless otherwise indicated) to about 10 percent, and shearing this mixture with a latex or emulsion mixture comprised of suspended submicron resin particles of from, for example, about 0.01 micron to about 2 microns in volume average diameter in an aqueous solution containing a counterionic surfactant in amounts of from about 1 percent to about 10 percent with opposite charge to the ionic surfactant of the pigment dispersion, and nonionic surfactant in amounts of from about 0 percent to about 5 percent, thereby causing a flocculation of resin particles, pigment particles and optional charge control agent, followed by heating at about 5° to about 40° C. below the resin Tg and preferably about 5° to about 25° C. below the resin Tg while stirring of the flocculent mixture which is believed to form statically bound aggregates of from about 1 micron to about 10 microns in volume average diameter comprised of resin, pigment and optionally charge control particles; adding additional ionic surfactant to ensure that the formed aggregates do not increase further in size in subsequent stages of the toner processing steps when subject to heating above the resin Tg, adding a water insoluble transition metal containing powder preferably containing copper or a copper/zinc alloy (bronze), and thereafter heating the formed bound aggregates about above the Tg (glass transition temperature) of the resin. The size of the aforementioned statistically bonded aggregated particles can be controlled by adjusting the temperature in the stage when heating the aggregates below the resin Tg. An increase in the temperature causes an increase in the size of the aggregated particle. This process of aggregating submicron latex and pigment particles is kinetically controlled, that is the temperature increases the aggregation rate. The higher the temperature during stirring the quicker the aggregates are formed, for example from about 2 to about 10 times faster in embodiments, and the submicron latex particles are consumed more rapidly. The temperature also controls in embodiments the particle size distribution of the aggregates, for example the higher the temperature the narrower the particle size distribution and this narrower distribution can be achieved in, for example, from about 0.5 to about 24 hours and preferably in about 1 to about 3 hours time. Heating the mixture about above or in embodiments equal to the resin Tg generates toner particles with, for example, an average particle volume diameter of from about 1 to about 25 and preferably between 3 and 10 microns. It is believed that during the heating stage, the components of aggregated particles fuse together to form composite toner particles. In another embodiment thereof, the present invention is directed to an in situ process comprised of first dispersing a pigment, such as HELIOGEN BLUE™ or HOSTAPERM PINK™, in an aqueous mixture containing a cationic surfactant such as benzalkonium chloride (SANIZOL B-50™), utilizing a high shearing device, such as a Brinkmann Polytron, microfluidizer or sonicator, thereafter shearing this mixture with a latex of suspended resin particles, such as poly(styrene butadiene acrylic acid), poly(styrene butylacrylate acrylic acid) or PLIOTONE™ a poly(styrene butadiene), and which particles are, for example, of a size ranging from about 0.01 to about 0.5 micron in volume average diameter as measured by the Brookhaven nanosizer in an aqueous surfactant mixture containing an anionic surfactant such as sodium dodecylbenzene sulfonate, for example NEOGEN R™ or NEOGEN SC™, and a nonionic surfactant such as alkyl phenoxy poly(ethylenoxy)ethanol, for example IGEPAL 897™ or ANTAROX 897™, thereby resulting in a flocculation, or heterocoagulation of the resin particles with the pigment particles; and which, on further stirring for about 1 to about 3 hours while heating, for example from about 35° to about 45° C., results in the formation of statically bound aggregates ranging in size of from about 0.5 micron to about 10 microns in average diameter size as measured by the Coulter Counter (Microsizer II), where the size of those aggregated particles and their distribution can be controlled by the temperature of heating, for example from about 5° to about 25° C. below the resin Tg, and where the speed at which toner size aggregates are formed can also be controlled by the temperature. A transition metal containing water insoluble powder is then added to the formed aggregrated particles. Thereafter, heating from about 5° to about 50° C. above the resin Tg provides for particle fusion or coalescence of the polymer and pigment particles forming particles that possess a substantially perfectly spherical morphology; followed by optional washing with, for example, hot water to remove surfactant; and drying whereby toner particles comprised of resin and pigment with various particle size diameters can be obtained, such as from 1 to about 20, and preferably between 3 and 10 microns in volume average diameter. The aforementioned toners are especially useful for the development of colored images with excellent line and solid resolution, and wherein substantially no background deposits are present. Also, the the spherical toner morphology combined with the narrow toner particle size distribution provides for toners with excellent powder flow properties.

While not being desired to be limited by theory, it is believed that the flocculation or heterocoagulation is caused by the neutralization of the pigment mixture containing the pigment and ionic, such as cationic, surfactant absorbed on the pigment surface with the resin mixture containing the resin particles and anionic surfactant absorbed on the resin particle. This process is kinetically controlled and an increase of, for example, from about 25° to about 45° C. of the temperature increases the flocculation, increasing from about 2.5 to 6 microns the size of the aggregated particles formed, and with a GSD change of from about 1.39 to about 1.20 as measured on the Coulter Counter; the GSD is decreased since at temperatures between 5° to 10° C. below the resin Tg (between 45° and 55° C.) the mobility of the particles is increased, and as a result all the submicron sized particles of both the resin and the pigment collide more often leading to rapid aggregate formation, for example aggregate formation can take 14 hours at 25° C. as opposed to 2 hours at 45° C. Thereafter, heating the aggregates, for example, from about 5° to about 80° C. above the resin Tg in the presence of the water insoluble transition metal powders, especially those containing copper results in aggregate fusing, or coalesces to form spherical toner particles being composites of polymer, pigments and optional toner additives such as charge control agents, waxes, and the like. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and thereby forming statically bounded aggregate particles by stirring and heating below the resin Tg; and thereafter, that is when the aggregates are formed, heating above the resin Tg to form stable toner composite particles.

The addition of a water insoluble powder containing a transition metal, such as copper, in effective amounts of, for example, between about 2 and about 50 grams and preferably between about 5 and about 20 grams per 500 grams of the solution of toner aggregates dispersed or contained in water during the process and prior to the coalescence step reduces the time needed to produce spherical toners from, for example, more than 6 hours when the coalescence is performed at 85° C. to less than half an hour. The size of the added transition powder can vary, for example from about 3 to about 50 and preferably is between about 5 and 10 microns in volume average diameter, as these sizes present an optimal surface area per gram of the powder. In embodiments, the water insoluble transition metal containing powder is preferably added to the aggregate suspension prior to heating the aggregates above the Tg of the resin, however, it can be added to other process steps of the present invention. There is enabled with the process of the present invention a number of advantages as illustrated herein, and including a more spherical toner and almost totally spherical, for example a potato like morphology.

In reprographic technologies, such as electrophotographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with, for example, an average volume particle of from about 2 to about 11 microns and preferably less than about 7 microns, and with narrow geometric size distribution (GSD) of from about 1.16 to about 1.3. Additionally, in some electrophotographic systems wherein process color is utilized, such as pictorial color applications, small particle size colored toners, preferably of from about 3 to about 9 microns, are highly desired to avoid the phenomenon of paper curling when paper is covered by a thick toner layer. Paper curling is especially observed in pictorial or process color applications wherein three to four layers of toners are transferred and fused onto paper. During the electrophotographic fusing step, moisture is driven from the paper at the high temperatures employed in fuser rolls, which ranges from about 130° to 160° C. When only one layer of toner is present, such as in black or in highlight xerographic applications, the amount of moisture driven off during fusing can be reabsorbed proportionally by paper and the resulting print remains relatively flat with minimal curl. In pictorial color process applications wherein three to four colored toner layers are present, a thicker layer of resin is present after the fusing step which can inhibit the paper from reabsorbing moisture lost during the fusing step, and image paper curl results. These and other disadvantages and problems are avoided or minimized with the toners and processes of the present invention. It is preferable to use small toner particle sizes, such as from about 2 to 7 microns, and with higher pigment loading, such as from about 5 to about 12 percent by weight of toner, such that the mass of toner layers deposited onto paper is reduced to obtain the same quality of image and resulting in a thinner plastic toner layer on paper after fusing, thereby minimizing or avoiding paper curling. Toners prepared in accordance with the present invention enable in embodiments the use of lower image fusing temperatures, such as from about 120° to about 150° C., thereby avoiding or minimizing paper curl. Lower fusing temperatures minimize the loss of moisture from paper, thereby reducing or eliminating paper curl. Furthermore, in process color applications and especially in pictorial color applications, a glossy toner layer is desired. Gloss matching is also often a requirement in pictorial prints; gloss matching is referred to as matching the gloss of the toner image to the natural gloss of the paper used in the electrophotographic copier/printer. For example, when a low gloss image of preferably from about 1 to about 30 gloss is desired, low gloss paper is utilized, such as from about 1 to about 30 gloss units as measured by the Gardner Gloss metering unit, and which after image formation with small particle size toners, preferably of from about 3 to about 5 microns and fixing thereafter, results in a low gloss toner image of from about 1 to about 30 gloss units as measured by the Gardner Gloss metering unit. Alternatively, when higher image gloss is desired, such as from about 30 to about 60 gloss units as measured by the Gardner Gloss metering unit, higher gloss paper is utilized, such as from about 30 to about 60 gloss units, and which after image formation with small particle size toners of the present invention of preferably from about 3 to about 5 microns, and fixing thereafter results in a higher gloss toner image of from about 30 to about 60 gloss units as measured by the Gardner Gloss metering unit. The aforementioned toner to paper matching can be attained with small particle size toners, such as less than 7 microns, and preferably less than 5 microns, such as from about 1 to about 4 microns, whereby the pile height of the toner layer or layers is considered low and acceptable.

Numerous processes are known for the preparation of toners, such as, for example, conventional processes, wherein a resin is melt blended or coextruded with a pigment, micronized and pulverized to provide toner particles with an average volume particle diameter of from about 9 microns to about 20 microns and with a broad geometric size distribution of from about 1.4 to about 1.7. In these processes, it is usually necessary to subject the aforementioned toners to a classification procedure such that the geometric size distribution of from about 1.2 to about 1.4 is attained. Also, in the aforementioned conventional process, low toner yields after classifications are often obtained. Generally, during the preparation of toners with a volume average size diameter of from about 11 microns to about 15 microns, there are obtained toner yields ranging from about 70 percent to about 85 percent after classification. Additionally, during the preparation of smaller sized toners with particle sizes of from about 7 microns to about 11 microns, lower toner yields can be obtained after classification, such as from about 50 percent to about 70 percent. With the processes of the present invention in embodiments, small average particle sizes of, for example, from about 3 microns to about 9 nucribs, and preferably 5 microns are attained without resorting to classification processes, and wherein narrow geometric size distributions are attained, such as from about 1.16 to about 1.30, and preferably from about 1.16 to about 1.25. High toner yields are also attained, such as from about 90 percent to about 98 percent, in embodiments of the present invention. In addition, by the toner particle preparation process of the present invention in embodiments, small particle size toners of from about 3 microns to about 7 microns can be economically prepared in high yields, such as from about 90 percent to about 98 percent by weight based on the weight of all the toner material ingredients, such as toner resin and pigment.

There is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, see column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention does not need to utilize polymer polar acid groups, and toners can be prepared with resins, such as poly(styrene-butadiene) or PLIOTONE™, containing no polar acid groups. Additionally, the process of the '127 patent does not appear to utilize counterionic surfactant and flocculation processes, and does not appear to use a counterionic surfactant for dispersing the pigment. In U.S. Pat. No. 4,983,488, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with a wide GSD. Furthermore, the '488 patent does not, it appears, disclose the process of counterionic, for example controlled aggregation is obtained by changing the counterionic strength, flocculation. Similarly, the aforementioned disadvantages, for example poor GSD are obtained hence classification is required resulting in low toner yields, are illustrated in other prior art, such as U.S. Pat. No. 4,797,339, wherein there is disclosed a process for the preparation of toners by resin emulsion polymerization, wherein similar to the '127 patent certain polar resins are selected, and wherein flocculation as in the present invention is not believed to be disclosed; and U.S. Pat. No. 4,558,108, wherein there is disclosed a process for the preparation of a copolymer of styrene and butadiene by specific suspension polymerization. Other prior art that may be of interest includes U.S. Pat. Nos. 3,674,736; 4,137,188 and 5,066,560.

The process described in the present application has several advantages as indicated herein including in embodiments the effective preparation of small spherical toner particles with narrow particle size distribution as a result of no classification; yields of toner are high; large amounts of power consumption are avoided; the process can be completed in rapid times therefore rendering it attractive and economical; and the particle size of the toner can be controlled by, for example, controlling the temperature of the aggregation.

In U.S. Pat. No. 5,290,654, the disclosure of which is totally incorporated herein by reference, there is illustrated a process for the preparation of toners comprised of dispersing a polymer solution comprised of an organic solvent and a polyester, and homogenizing and heating the mixture to remove the solvent and thereby form toner composites. Additionally, there is illustrated in U.S. Pat. No. 5,278,020, the disclosure of which is totally incorporated herein by reference, a process for the preparation of a toner composition comprising the steps of (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;

(ii) polymerizing the latex emulsion mixture by heating from ambient temperature to about 80° C. to form nonpolar olefinic emulsion resin particles of volume average diameter of from about 5 nanometers to about 500 nanometers;

(iii) diluting the nonpolar olefinic emulsion resin particle mixture with water;

(iv) adding to the diluted resin particle mixture a colorant or pigment particles and optionally dispersing the resulting mixture with a homogenizer;

(v) adding a cationic surfactant to flocculate the colorant or pigment particles to the surface of the emulsion resin particles;

(vi) homogenizing the flocculated mixture at high shear to form statically bound aggregated composite particles with a volume average diameter of less than or equal to about 5 microns;

(vii) heating the statically bound aggregate composite particles to form nonpolar toner sized particles;

(viii) halogenating the nonpolar toner sized particles to form nonpolar toner sized particles having a halopolymer resin outer surface or encapsulating shell; and (ix) isolating the nonpolar toner sized composite particles.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In U.S. Pat. No. 5,346,797, the disclosure of which is totally incorporated herein by reference, there is illustrated a process for the preparation of toner compositions comprising (i) preparing a pigment dispersion in water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bounded toner size aggregates; and (iii) heating the statically bound aggregated particles above the resin Tg to form said toner composition comprised of polymeric resin, pigment and optionally a charge control agent.

In U.S. Pat. No. 5,364,729, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin, to form electrostatically bound toner size aggregates with a narrow particle size distribution; and (iv) heating said bound aggregates above about the Tg of the resin.

There are a number of advantages of the processes of the present invention compared, for example, to those illustrated above, such as the 5,364,729 patent including, for example, the formation of spherical toners and single component toners which have greatly enhanced powder flow characteristics as compared to the substantially nonspherical particles generated using prior art processes. An additional advantage provided by the spherical toners is that they exhibit a low surface area per unit toner mass, more than twice less toner surface area per gram of a toner of similar particle size than for a toner with a rugged surface, which in turn allows for the use of, for example, less than half the quantity of external charge control additives than would be required in the higher surface area nonspherical toners.

In U.S. Pat. No. 5,370,963, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In U.S. Pat. No. 5,344,738, the disclosure of which is totally incorporated herein by reference, there is illustrated a process for the preparation of toner compositions with a volume median particle size of from about 1 to about 25 microns, which process comprises:

(i) preparing by emulsion polymerization a charged polymeric latex of submicron particle size;

(ii) preparing a pigment dispersion in water, which dispersion is comprised of a pigment, an effective amount of cationic flocculant surfactant, and optionally a charge control agent;

(iii) shearing the pigment dispersion (ii) with a polymeric latex (i) comprised of resin, a counterionic surfactant with a charge polarity of opposite sign to that of said ionic surfactant thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent.

In U.S. Pat. No. 5,403,963, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In U.S. Pat. No. 5,418,108, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In U.S. Pat. No. 5,405,728, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) surfactant and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ chemical processes for black and colored toner compositions by an aggregation process comprised of (i) preparing a cationic pigment mixture containing pigment particles, and optionally charge control agents and other known optional additives dispersed in a water containing a cationic surfactant by shearing, microfluidizing or ultrasonifying; (ii) shearing the pigment mixture with a latex mixture comprised of a polymer resin, anionic surfactant and nonionic surfactant thereby causing a flocculation of the latex particles with pigment particles, which on further stirring allows for the formation of electrostatically stable aggregates of from about 0.5 to about 5 microns in volume diameter as measured by the Coulter Counter; (iii) adding additional, for example 1 to 10 weight percent of anionic or nonionic, surfactant to the formed aggregates to, for example, increase their stability and to retain the particle size and particle size distribution during the heating stage; adding a water insoluble transition metal containing powder, such as for example a copper or bronze powder, to the resulting mixture; and (iv) coalescing or fusing the aforementioned aggregated particle mixture by heat to form toner composites, a toner composition or toner particles comprised of resin, pigment, and charge additive.

In a further object of the present invention there is provided a process for the preparation of spherical toner compositions with an average particle volume diameter of from between about 1 to about 20 microns, and preferably from about 1 to about 7 microns, and with a narrow GSD of from about 1.2 to about 1.3, and preferably from about 1.16 to about 1.25 as measured by a Coulter Counter.

In a further object of the present invention there is provided a process for the preparation of toner compositions with certain effective particle sizes by controlling the temperature of the aggregation which comprises stirring and heating about below and above the resin glass transition temperature (Tg); and wherein the addition of powders like copper during the process, such as during coalescence, reduced, for example, by 50 percent the emulsion/aggregation time, and enabling conductive toners, such as single component toners.

Moreover, in a further object of the present invention there is provided a process for the preparation of toner compositions which after fixing to paper substrates results in images with a gloss of from 20 GGU (Gardner Gloss Units) up to 70 GGU as measured by Gardner Gloss meter matching of toner and paper.

In another object of the present invention there is provided a composite toner of polymeric resin with pigment and optional charge control agent in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with a high projection efficiency, such as from about 75 to about 95 percent efficiency as measured by the Match Scan II spectrophotometer available from Milton-Roy.

In a further object of the present invention there are provided toner compositions which result in minimal, low or no paper curl.

Another object of the present invention resides in processes for the preparation of small sized toner particles with narrow GSDs, and excellent pigment dispersion by the aggregation of latex particles with pigment particles dispersed in water and a surfactant, and wherein the aggregated particles of toner size can then be caused to coalesce by, for example, heating. In embodiments, some factors of interest with respect to controlling particle size and particle size distribution include the concentration of the surfactant used for the pigment dispersion, the concentration of the resin component like acrylic acid in the latex, the temperature of coalescence, and the time of coalescence.

In another object of the present invention there are provided processes for the preparation of toner comprised of resin and pigment, which toner can be of a preselected size, such as from about 1 to about 10 microns in volume average diameter, and with narrow GSD by the aggregation of latex or emulsion particles, which aggregation can be accomplished with stirring in excess of 25° C., and below about the Tg of the toner resin, for example at 45° C., followed by heating the formed aggregates above about the resin Tg to allow for coalescence; an essentially three step process of blending, aggregation and coalescence; and which process can in embodiments be completed in 8 or less hours. The process can comprise dispersing pigment particles in water/cationic surfactant using microfluidizer; blended the dispersion with a latex using a SD41 mixer, which allows continuous pumping and shearing at high speed, which is selected to break initially formed flocks or flocs, thus allowing controlled growth of the particles and better particle size distribution; the pigment/latex blend is then transferred into the kettle equipped with a mechanical stirrer and a temperature probe, and heated up to 35° C. or 45° C. to perform the aggregation. Negatively charged latex particles are aggregating with pigment particles dispersed in cationic surfactant and the aggregation can be continued for 3 hours. This is usually sufficient time to provide a narrow GSD. The temperature is a factor in controlling the particle size and GSD in the initial stage of aggregation (kinetically controlled), the lower the temperature of aggregation, the smaller the particles; and the particle size and GSD achieved in the aggregation step can be retained in the coalescence step by addition of extra anionic surfactant prior to the coalescence. The resulting aggregated particles are heated 20° to 30° C. above their polymer Tg for coalescence; particles are filtered on the Buchner funnel and washed with hot water to remove the surfactants; and the particles are dried in a freeze dryer, spray dryer, or fluid bed dried.

These and other objects of the present invention are accomplished in embodiments by the provision of toners and processes thereof. In embodiments of the present invention, there are provided processes for the preparation by chemical means of toner compositions by flocculation or heterocoagulation, and coalescence, and wherein the temperature of aggregation can be utilized to control the final toner particle size, that is average volume diameter.

In embodiments, the present invention is directed to processes for the preparation of spherical toner compositions which comprises initially attaining or generating an ionic aqueous, that is water, pigment dispersion by, for example, dispersing an aqueous mixture of a pigment or pigments, such as carbon black like REGAL 330®, phthalocyanine, quinacridone or RHODAMINE B™ with a cationic surfactant, such as benzalkonium chloride, thereafter shearing this mixture by utilizing a high shearing device, such as a Brinkmann Polytron, a sonicator or microfluidizer with a suspended resin mixture comprised of polymer components such as poly(styrene butadiene) or poly(styrene butylacrylate); and wherein the particle size of the suspended resin mixture is, for example, from about 0.01 to about 0.5 micron in an aqueous surfactant mixture containing an anionic surfactant such as sodium dodecylbenzene sulfonate and nonionic surfactant; resulting in a flocculation, or heterocoagulation of the polymer or resin particles with the pigment particles caused by the neutralization of anionic surfactant absorbed on the resin particles with the oppositely charged cationic surfactant absorbed on the pigment particle; and further stirring the mixture using a mechanical stirrer at 250 to 500 rpm while heating below about the resin Tg, for example from about 5° to about 15° C., and allowing the formation of electrostatically stabilized aggregates ranging from about 0.5 micron to about 10 microns; adding thereto a water insoluble metal containing powder, such as copper or bronze, in effective amounts of, for example, from about 5 to about 20, and preferably from about 5 to about 10 grams of powder per 500 grams of the aforementioned suspension of aggregates; followed by heating above about the resin Tg, for example from about 5° to about 50° C., to cause coalescence of the latex, pigment particles and followed by washing with, for example, hot water to remove, for example, surfactant, and drying such as by use of an Aeromatic fluid bed dryer, freeze dryer, or spray dryer; whereby toner particles comprised of resin pigment, and optional charge control additive with various particle size diameters can be obtained, such as from about 1 to about 10 microns in average volume particle diameter as measured by the Coulter Counter.

Embodiments of the present invention include a process for the preparation of spherical toner compositions comprised of resin and pigment comprising (i) preparing a water pigment dispersion in a water, which dispersion is comprised of a pigment, an ionic surfactant and optionally a charge control agent;

(ii) shearing the pigment dispersion with a water latex mixture comprised of polymeric or resin particles in water and counterionic surfactant with a charge polarity of opposite sign to that of said ionic surfactant, and a nonionic surfactant;

(iii) heating the resulting homogenized mixture below about the resin Tg at a temperature of from about 35° to about 50° C. (or 5° to 20° C. below the resin Tg) thereby causing flocculation or heterocoagulation of the formed particles of pigment, resin and charge control agent to form electrostatically bounded toner size aggregates, followed by adding thereto a water insoluble transition metal containing powder comprised of metal powders, metal alloys, water insoluble metal compounds, or mixtures thereof in embodiments, and wherein the metal may be copper, zinc, iron, cobalt, nickel, molybdenum, manganese, chromium, vanadium, or titanium with examples of preferred powders including copper metal, copper/zinc alloys, bronze powder, or zinc oxide with 200 mesh size pure copper metal powder being preferred in embodiments; and wherein the water insoluble transition metal containing powder may be added prior to or during (iv); and (iv) heating to, for example, from about 60° to about 95° C. the statically bound aggregated particles of (iii) to form said toner composition comprised of polymeric resin and pigment.

Embodiments of the present invention include a process for the preparation of spherical toner compositions comprised of resin and pigment comprising (i) preparing a pigment dispersion in water, which dispersion is comprised of a pigment, an ionic surfactant and optionally a charge control agent;

(ii) shearing the pigment dispersion with a latex mixture comprised of polymeric or resin particles in water and counterionic surfactant with a charge polarity of opposite sign to that of the ionic surfactant, and a nonionic surfactant;

(iii) heating the resulting homogenized mixture below about the resin Tg at a temperature of from about 35° to about 50° C. (or 5° to 20° C. below the resin Tg) thereby causing flocculation or heterocoagulation of the formed particles of pigment, resin and charge control agent to form electrostatically bounded toner size aggregates;

(iv) heating to, for example, from about 60° to about 95° C. the statically bound aggregated particles of (iii) to form the toner composition comprised of polymeric resin, pigment and optionally a charge control agent; and (v) adding thereto, preferably during or prior to (iii), a water insoluble transition metal containing powder comprised of metal powders, metal alloys, water insoluble metal compounds wherein the metal is copper, zinc, iron, cobalt, nickel, molybdenum, manganese, chromium, vanadium, or titanium with preferred powders being pure copper metal, a copper/zinc alloy or bronze powder, and zinc oxide with the most preferred powder being a 200 mesh pure copper powder; heating the toner suspension for an additional period between 0.5 and 2 hours between 60° to about 95° C. to form spherical toner particles, followed by insualtion and drying of the particles.

Also, in embodiments the present invention is directed to processes for the preparation of toner compositions which comprise (i) preparing an ionic pigment mixture by dispersing a pigment such as carbon black like REGAL 330®, HOSTAPERM PINK™, or PV FAST BLUE™ of from about 2 to about 10 percent by weight of toner in an aqueous mixture containing a cationic surfactant such as dialkylbenzene dialkylammonium chloride like SANIZOL B-50™ available from Kao or MIRAPOL™ available from Alkaril Chemicals, and from about 0.5 to about 2 percent by weight of water utilizing a high shearing device such as a Brinkmann Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrene-butylmethacrylate), PLIOTONE™ or poly(styrene-butadiene) and which resin particles are present in various effective amounts, such as from about 40 percent to about 98 percent by weight of the toner, and wherein the polymer resin latex particle size is from about 0.1 micron to about 3 microns in volume average diameter, and counterionic surfactant, such as an anionic surfactant like sodium dodecylsulfate, dodecylbenzene sulfonate or NEOGEN R™, from about 0.5 to about 2 percent by weight of water, a nonionic surfactant, such polyethylene glycol or polyoxyethylene glycol nonyl phenyl ether or IGEPAL 897™ obtained from GAF Chemical Company, from about 0.5 to about 3 percent by weight of water, thereby causing a flocculation or heterocoagulation of pigment, charge control additive and resin particles; (iii) diluting the mixture with water to enable from about 50 percent to about 15 percent of solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to 500 rpm about below the resin Tg at, for example, about 5° to about 15° C. below the resin Tg at temperatures of about 35° to about 50° C. to form electrostatically stable aggregates of from about 0.5 micron to about 10 microns in volume average diameter followed by adding thereto a water insoluble transition metal containing powder; (v) adding additional anionic surfactant or nonionic surfactant in the amount of from 0.5 percent to 5 percent by weight of water to stabilize the aggregates formed in step (iv), heating the statically bound aggregate composite particles at from about 60° C. to about 135° C. for a duration of about 60 minutes to about 600 minutes to form toner sized particles of from about 3 microns to about 7 microns in volume average diameter and with a geometric size distribution of from about 1.2 to about 1.3 as measured by the Coulter Counter; and (vi) isolating the toner sized particles by washing, filtering and drying thereby providing composite toner particles comprised of resin and pigment. Flow additives to improve flow characteristics and charge additives, if not initially present, to improve charging characteristics may then be added by blending with the formed toner, such additives including AEROSILS® or silicas, metal oxides like tin, titanium and the like, metal salts of fatty acids like zinc stearate, and which additives are present in various effective amounts, such as from about 0.1 to about 10 percent by weight of the toner. The continuous stirring in step (iii) can be accomplished as indicated herein, and generally can be effected at from about 200 to about 1,000 rpm for from about 1 hour to about 24 hours, and preferably from about 12 to about 6 hours.

Embodiments of the present invention include a process for the preparation of toner compositions with controlled particle size, or a particle size of from about 1 to about 25 and preferably from 3 to about 10 microns in average volume diameter comprising:

(i) preparing a pigment dispersion in water, which dispersion is comprised of a pigment of a diameter of from about 0.01 to about 1 micron, an ionic surfactant, and optionally a charge control agent;

(ii) shearing the pigment dispersion with a latex water blend of resin particles of submicron size of from about 0.01 to about 1 micron, a counterionic surfactant with a charge polarity, positive or negative, of opposite sign to that of said ionic surfactant and a nonionic surfactant thereby causing a flocculation or heterocoagulation of the formed particles of pigment, resin and charge control agent to form a uniform dispersion of solids in the water and surfactant system;

(iii) heating the above sheared blend at a temperature of from about 5° to about 20° C. below the Tg of the resin particles while continuously stirring to form electrostatically bound or attached relatively stable (for Coulter Counter measurements) toner size aggregates with a narrow particle size distribution; adding a water insoluble transition metal containing powder and additional ionic surfactant;

(iv) heating the statically bound aggregated particles of (iii) at a temperature of from about 5° to about 50° C. above the Tg of the resin to provide a mechanically stable toner composition comprised of polymeric resin, pigment and optionally a charge control agent;

(v) separating the said toner particles from the water by filtration; and (vi) drying the said toner particles, and wherein about below and about above can include in embodiments equal to the Tg.

In embodiments, the present invention is directed to a process for the preparation of toner compositions with controlled particle size comprising:

(i) preparing a pigment dispersion in water, which dispersion is comprised of a pigment, an ionic surfactant and optionally a charge control agent;

(ii) shearing the pigment dispersion with a latex blend comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent to form a uniform dispersion of solids in the water and surfactant;

(iii) heating the above sheared blend below about or about equal to the glass transition temperature (Tg) of the resin while continuously stirring to form electrostatically bound toner size aggregates with a narrow particle size distribution and adding, prior to or during heating, a water insoluble metal containing powder and additional ionic surfactant thereto;

(iv) heating the statically bound aggregated particles about above or about equal to the Tg of the resin to provide a toner composition comprised of polymeric resin, pigment and optionally a charge control agent;

(v) separating said toner particles from said water by filtration; and (vi) drying said toner particles.

In embodiments, the heating in (iii) is accomplished at a temperature of from about 29° to about 59° C.; the resin Tg in (iii) is from about 50° to about 80° C.; heating in (iv) is from about 5° to about 50° C. above the Tg; and wherein the resin Tg in (iv) is from about 50° to about 80° C.

In embodiments, heating below the glass transition temperature (Tg) can include heating at about the glass transition temperature or slightly higher. Heating above the Tg can include heating at about the Tg or slightly below the Tg, in embodiments.

Embodiments of the present invention include a process for the preparation of spherical toner compositions with controlled particle size comprising:

(i) preparing a pigment dispersion in water, which dispersion is comprised of a pigment of a diameter of from about 0.01 to about 1 micron, an ionic surfactant, and optionally a charge control agent;

(ii) shearing the pigment dispersion with a latex blend comprised of water and resin particles of submicron size of from about 0.01 to about 1 micron, a counterionic surfactant with a charge polarity, for example positive or negative, of opposite sign to that of said ionic surfactant, which can be positive or negative, and a nonionic surfactant thereby causing a flocculation or heterocoagulation of the formed particles of pigment, resin and charge control agent to form a uniform dispersion of solids in the water and surfactant;

(iii) heating the above sheared blend at a temperature of from about 5° to about 20° C., and in embodiments about zero to about 20° C. below the Tg of the resin particles while continuously stirring to form electrostatically bounded or bound relatively stable (for Coulter Counter measurements) toner size aggregates with a narrow particle size distribution; adding a transition metal containing powder and adding additional ionic surfactant in an amount of from about 0.02 to about 5, and preferably about 0.5 to about 2 weight percent of the aggregate suspension to further ensure that the aggregates do not increase in size when subjected to further heating in (iv);

(iv) heating the statically bound aggregated particles at a temperature at from about 5° to about 50° C., and in embodiments about zero to about 50° C. above the Tg of the resin to provide a mechanically stable toner composition comprised of polymeric resin, pigment and optionally a charge control agent;

(v) separating the toner particles from the water by filtration; and (vi) drying the toner particles.

In embodiments, the present invention is directed to a process for the preparation of spherical toner compositions with controlled particle size comprising:

(i) preparing a pigment dispersion in water, which dispersion is comprised of a pigment and an ionic surfactant;

(ii) shearing the pigment dispersion with a latex blend comprised of resin of submicron size, a counterionic surfactant with a charge polarity of opposite sign to that of said ionic surfactant and a nonionic surfactant thereby causing a flocculation or heterocoagulation of the formed particles of pigment and resin to form a uniform dispersion of solids in the water and surfactant;

(iii) heating the above sheared blend below about the glass transition temperature (Tg) of the resin while continuously stirring to form electrostatically bounded or bound toner size aggregates with a narrow particle size distribution; adding a metal containing powder thereto; and (iv) heating the statically bound aggregated particles above about the Tg of the resin to provide a toner composition comprised of polymeric resin and pigment. Toner and developer compositions thereof are also encompassed by the present invention in embodiments.

The pigment and latex contain water in effective amounts, for example at least about 50, preferably at least 60 percent of water.

Illustrative examples of specific resin particles, resins or polymers selected for the process of the present invention include known polymers such as poly(styrene-butadiene), poly(para-methyl styrene-butadiene), poly(meta-methyl styrene-butadiene), poly(alpha-methyl styrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); polymers such as poly(styrene-butadiene-acrylic acid), poly(styrene-butadiene-methacrylic acid), PLIOTONE™ available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, POLYLITE™ (Reichhold Chemical Inc), PLASTHALL™

(Rohm & Hass), CYGAL™ (American Cyanamide), ARMCO™ (Armco Composites), CELANEX™ (Celanese Eng), RYNITE™ (DuPont), STYPOL™, and the like. The resin selected, which generally can be in embodiments styrene acrylates, styrene butadienes, styrene methacrylates, or polyesters, are present in various effective amounts, such as from about 85 weight percent to about 98 weight percent of the toner, and can be of small average particle size, such as from about 0.01 micron to about 1 micron in average volume diameter as measured by the Brookhaven nanosize particle analyzer. Other sizes and effective amounts of resin particles may be selected in embodiments, for example copolymers of poly(styrene butylacrylate acrylic acid) or poly(styrene butadiene acrylic acid).

The resin selected for the process of the present invention is preferably prepared from emulsion polymerization methods, and the monomers utilized in such processes include styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride, and the like. The presence of acid or basic groups is optional and such groups can be present in various amounts of from about 0.1 to about 10 percent by weight of the polymer resin. Known chain transfer agents, for example dodecanethiol, about 1 to about 10 percent, or carbon tetrabromide in effective amounts, such as from about 1 to about 10 percent, can also be selected when preparing the resin particles by emulsion polymerization. Other processes of obtaining resin particles of from, for example, about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding processes, or other known processes.

Various known colorants or pigments present in the toner in an effective amount of, for example, from about 1 to about 25 percent by weight of the toner, and preferably in an amount of from about 1 to about 15 weight percent, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™ , MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™ and cyan components may also be selected as pigments with the process of the present invention. The pigments selected are present in various effective amounts, such as from about 1 weight percent to about 65 weight percent and preferably from about 2 to about 12 weight percent of the toner.

The toner may also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in amounts of, for example, 0.1 to about 25 weight percent in embodiments include, for example, nonionic surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the nonionic surfactant is in embodiments, for example, from about 0.01 to about 10 percent by weight, and preferably from about 0.1 to about 5 percent by weight of monomers used to prepare the copolymer resin.

Examples of ionic surfactants include anionic and cationic with examples of anionic surfactants being, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. An effective concentration of the anionic surfactant generally employed is, for example, from about 0.01 to about 10 percent by weight, and preferably from about 0.1 to about 5 percent by weight of monomers used to prepare the copolymer resin particles of the emulsion or latex blend.

Examples of the cationic surfactants, which are usually positively charged, selected for the toners and processes of the present invention include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™ available from Alkaril Chemical Company, SANIZOL™ (benzalkonium chloride), available from Kao Chemicals, and the like, and mixtures thereof. This surfactant is utilized in various effective amounts, such as for example from about 0.1 percent to about 5 percent by weight of water. Preferably, the molar ratio of the cationic surfactant used for flocculation to the anionic surfactant used in the latex preparation is in the range of from about 0.5 to 4, and preferably from 0.5 to 2.

Counterionic surfactants are comprised of either anionic or cationic surfactants as illustrated herein and in the amount indicated, thus, when the ionic surfactant of step (i) is an anionic surfactant, the counterionic surfactant is a cationic surfactant.

Examples of the surfactant, which are added to the aggregated particles to "freeze" or retain particle size, and GSD achieved in the aggregation can be selected from the anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, and the like. They can also be selected from nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective concentration of the anionic or nonionic surfactant generally employed as a "freezing agent" or stabilizing agent is, for example, from about 0.01 to about 10 percent by weight, and preferably from about 0.5 to about 5 percent by weight of the total weight of the aggregate comprised of resin latex, pigment particles, water, ionic and nonionic surfactants mixture.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972®available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. No. 4,265,660, the disclosure of which is totally incorporated herein by reference.

The following Examples are being submitted to further define various species of the present invention. These Examples are intended to be illustrative only and are not intended to limit the scope of the present invention. Also, parts and percentages are by weight unless otherwise indicated. Comparative Examples are also provided.

EXAMPLES

Pigment dispersion:

140 Grams of dry pigment PV FAST BLUE™ and 29.2 grams of cationic surfactant SANIZOL B-50™ were dispersed in 4,000 grams of water using a micronizer. This pigment dispersion was used in the Examples that follow.

Latex (Resin dispersion):

A latex was prepared by emulsion polymerization of styrene:butylacrylate and acrylic acid (82:18 with 2 pph acrylic acid) in nonionic/anionic surfactant solution (3 percent) as follows. 352 Grams of styrene, 48 grams of butyl acrylate, 8 grams of acrylic acid, and 12 grams of dodecanethiol were mixed with 600 milliliters of deionized water in which 9 grams of sodium dodecyl benzene sulfonate anionic surfactant (NEOGEN R™ which contains 60 percent of active component), 8.6 grams of polyoxyethylene nonyl phenyl ether—nonionic surfactant (ANTAROX 897™—70 percent active), and 4 grams of ammonium persulfate initiator were dissolved. The emulsion was then polymerized at 70° C. for 8 hours. The resulting latex, 60 percent water and 40 percent (weight percent throughout) solids, was comprised of a copolymer of poly(styrene-butyl acrylate-acrylic acid); the Tg of the latex dry sample was 53.1° C., as measured on a DuPont DSC; $M_w$=26,600, and $M_n$=1,200 as determined on Hewlett Packard GPC. The zeta potential of the latex as measured on Pen Kem Inc. Laser Zee Meter was −80 millivolts. The latex particle size as measured on Brookhaven BI-90 Particle Nanosizer was 147 nanometers. The aforementioned latex was then employed for the toner preparation of the Comparative Examples 1 and 2 and the transition metal containing powder Examples I to VI.

COMPARATIVE EXAMPLE 1

Preparation of Toner Size Particles Without Transition Metal Containing Powder:

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex was then added while the shearing was continued. Shearing was continued for an additional 8 minutes at 10,000 rpm. 800 Grams of the resulting blend were then transferred to a kettle placed in the heating mantle and equipped with mechanical stirrer and temperature probe. The temperature of the mixture was raised from 25° C. to 45° C. and aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step that follows Coalescence of aggregated particles was performed by raising the temperature of the aggregated particles in the kettle to 80° C. The heating was continued at 80° C. for 3 hours to coalesce the aggregated particles. No change in the particle size of 4.2 microns or GSD of 1.25 was observed in this stage. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.2 microns and the GSD was 1.25, and the particles have a surface that is not smooth exhibiting many surface asperities.

COMPARATIVE EXAMPLE 2

Preparation of Toner in the Presence of a Non-transition Metal Powder:

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex were then added while the shearing was continued. Shearing was continued for an additional 8 minutes at 10,000 rpm. 800 Grams of the formed blend were then transferred to a kettle placed in the heating mantle and equipped with mechanical stirrer and temperature probe. The temperature of the mixture was raised from 25° C. to 45° C. and this aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step which involves heating the aggregate suspension above the Tg of the resin.

7 Grams of aluminum powder were added to the aggregated suspension and coalescence of aggregated particles was performed by raising the temperature of the aggregated particles in the kettle to 90° C. The heating was continued at 90° C. for 3 hours to coalesce the aggregated particles. No change in the particle size and the GSD was observed in this stage. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.4 microns and the GSD was 1.23. The toner was observed to be nonspherical exhibiting the same irregular characteristics and surface asperities as the toner of Comparative Example 1.

EXAMPLE I

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex were then added while the shearing was continued. Shearing was continued for an additional 8 minutes at 10,000 rpm. 800 Grams of the resulting blend were then transferred to a kettle placed in the heating mantle and equipped with mechanical stirrer and temperature probe. The temperature of the mixture was raised from 25° C. to 45° C. and this aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step which involves heating the aggregate suspension above the Tg of the resin.

9 Grams of STANDART® bronze, a copper rich copper zinc alloy with an average particle size of 5 microns, pigment powder obtained from Eckart-Werke, Germany were added to the aggregated suspension and coalescence of aggregated particles was performed by raising the temperature of the aggregated particles in the kettle to 90° C. The heating was continued at 90° C. for 3 hours to coalesce the aggregated particles. No change in the particle size, 4.5 microns and GSD of 1.21 was observed at this stage. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.5 microns and the GSD was 1.21. The toner particles formed in this manner were observed by microscopic examination to be perfectly spherical exhibiting none of the rough surface structures of the Comparative Examples 1 and 2.

EXAMPLE II

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex and 9 grams of STANDART® bronze pigment powder obtained from Eckart-Werke, Germany were then added while the shearing was continued. Shearing was continued for an additional 8 minutes at 10,000 rpm. 800 Grams of the resulting blend were then transferred to a kettle placed in the heating mantle and equipped with mechanical stirrer and temperature probe. The temperature of the mixture was raised from 25° C. to 45° C. and this aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step which involves heating the aggregate suspension above the Tg of the resin.

Coalescence of aggregated particles was performed by raising the temperature of the aggregated particles in the kettle to 90° C. The heating was continued at 90° C. for 3 hours to coalesce the aggregated particles. No change in the particle size, 4.5 microns, and the GSD, 1.22, was observed in this stage. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.5 microns and the GSD was 1.22. The toner particles formed in this manner were visually observed to be perfectly spherical exhibiting none of the rough surface structures of the Comparative Examples 1 and 2.

EXAMPLE III

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex were then added while the shearing was continued. Shearing was continued for an additional 8 minutes at 10,000 rpm. 800 Grams of this blend were then transferred to a kettle placed in the heating mantle and equipped with mechanical stirrer and temperature probe. The temperature of the mixture was raised from 25° C. to 45° C. and this aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step which involves heating the aggregate suspension above the Tg of the resin.

8 Grams of copper powder 200 mesh obtained from Aldrich Chemicals were then added and coalescence of aggregated particles was performed by raising the temperature of the aggregated particles in the kettle to 90° C. The heating was continued at 90° C. for 3 hours to coalesce the aggregated particles. No change in the particle size, 4.3 microns, and the GSD, 1.20, was observed at this point. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.3 microns and the GSD was 1.20. The toner particles formed in this manner were observed to be perfectly spherical exhibiting none of the rough surface structures of the Comparative Examples 1 and 2.

EXAMPLE IV

400 Grams of the above dispersion of the PV FAST BLUE™ were placed in the SD41 continuous blender along with 400 grams of deionized water containing 2.92 grams of the cationic surfactant SANIZOL B-50™. The aforementioned pigment dispersion was sheared for 3 minutes at 10,000 rpm. 650 Grams of the above latex were then added while the shearing was continued. Shearing was continued for an additional 8 minutes at 10,000 rpm. 800 Grams of this blend were then transferred to a kettle placed in the heating mantle and equipped with mechanical stirrer and temperature probe. The temperature of the mixture was raised from 25° C. to 450° C. and this aggregation was performed while stirring at 400 rpm for 2 hours. The stirring rate was reduced to 100 rpm and 80 milliliters of a 20 percent by weight aqueous solution of NEOGEN R™ were then added to the aggregate suspension to ensure that further aggregation did not occur on heating the suspension above the Tg of the resin in the coalescence step which involves heating the aggregate suspension above the Tg of the resin.

8 Grams of a copper bronze flake alloy obtained from Aldrich Chemical Company were then added and coalescence of aggregated particles was performed by raising the temperature of the aggregated particles in the kettle to 90° C. The heating was continued at 90° C. for 30 minutes to coalesce the aggregated particles. No change (determined by Coulter Counter measurements throughout) in the particle size and the GSD was observed in this stage. Particles were filtered, washed using hot deionized water, and dried on the freeze dryer. The resulting cyan toner was comprised of 95 percent resin of poly(styrene-co-butylacrylate-co-acrylic acid), and 5 percent of PV FAST BLUE™ pigment. The volume average toner particle size was determined to be 4.2 microns and the GSD was 1.21. The toner particles formed in this manner were observed to be perfectly spherical exhibiting none of the rough surface structures of the Comparative Examples 1 and 2.

Other modifications of the present invention may occur to those skilled in the art subsequent to a review of the present application and these modifications, including equivalents thereof, are intended to be included within the scope of the present invention.

What is claimed is:

1. A process for the preparation of toner comprising:

(i) preparing a pigment dispersion comprised of pigment, an ionic surfactant, and optionally a charge control agent;

(ii) shearing said pigment dispersion with a latex comprised of resin, a counterionic surfactant with a charge polarity of opposite sign to that of said ionic surfactant, and a nonionic surfactant;

(iii) heating the above sheared blend of (ii) below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder in an amount of from between about 0.05 and about 5 weight percent based on the weight of the aggregates; and (iv) heating said bound aggregates above the Tg of the resin to form toner, and wherein said water insoluble transition metal containing powder is a copper metal powder.

2. A process for the preparation of toner comprising:

(i) preparing a pigment dispersion comprised of pigment, an ionic surfactant, and optionally a charge control agent;

(ii) shearing said pigment dispersion with a latex comprised of resin, a counterionic surfactant with a charge polarity of opposite sign to that of said ionic surfactant, and a nonionic surfactant;

(iii) heating the above sheared blend of (ii) below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder in an amount of from between about 0.05 and about 5 weight percent based on the weight of the aggregates; and (iv) heating said bound aggregates above the Tg of the resin to form toner, and wherein said water insoluble transition metal containing powder is a copper alloy.

3. A process for the preparation of toner comprising:

(i) preparing a pigment dispersion comprised of pigment, an ionic surfactant, and optionally a charge control agent;

(ii) shearing said pigment dispersion with a latex comprised of resin, a counterionic surfactant with a charge polarity of opposite sign to that of said ionic surfactant, and a nonionic surfactant;

(iii) heating the above sheared blend of (ii) below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder in an amount of from between about 0.05 and about 5 weight percent based on the weight of the aggregates; and (iv) heating said bound aggregates above the Tg of the resin to form toner, and wherein said water insoluble transition metal containing powder is bronze.

4. A process for the preparation of toner comprising:

(i) preparing a pigment dispersion comprised of pigment, an ionic surfactant, and optionally a charge control agent;

(ii) shearing said pigment dispersion with a latex comprised of resin, a counterionic surfactant with a charge polarity of opposite sign to that of said ionic surfactant, and a nonionic surfactant;

(iii) heating the above sheared blend of (ii) below the glass transition temperature (Tg) of the resin, to form electrostatically bound toner size aggregates with a volume average diameter of from between about 2 and about 15 microns and with a narrow particle size distribution as reflected in the particle diameter GSD of between about 1.15 and about 1.30, followed by the addition of a water insoluble transition metal containing powder in an amount of from between about 0.05 and about 5 weight percent based on the weight of the aggregates; and (iv) heating said bound aggregates above the Tg of the resin to form toner, wherein said toner comprised of resin particles and pigment particles is isolated and dried, and wherein said water insoluble transition metal containing powder is bronze.

* * * * *